US005722098A

United States Patent [19]

Stern

[11] Patent Number: 5,722,098

[45] Date of Patent: Mar. 3, 1998

[54] SWIMMING POOL COVER WITH DRAINAGE AND FILTER MEANS

[76] Inventor: Robert Stern, 1746 Lakewood Rd., Toms River, N.J. 08755

[21] Appl. No.: 745,878

[22] Filed: Nov. 8, 1996

[51] Int. Cl.[6] ..... E04H 4/00

[52] U.S. Cl. ..... 4/498; 4/503

[58] Field of Search ..... 4/498, 499, 500, 4/501, 502, 503; 210/257.1, 257.2

[56] References Cited

U.S. PATENT DOCUMENTS 3,184,764 5/1965 West ..... 4/498

5,259,078 11/1993 Crandall ..... 4/498

*Primary Examiner*—David J. Walczak

*Attorney, Agent, or Firm*—Clifford G. Frayne

[57] ABSTRACT

A cover for a water pool comprised of flexible waterproof material having a drainage opening positioned therein and a sleeve defining a passageway secured on the cover and in alignment with and intersecting the drainage opening allowing a filter means to be slidably positionable therein for filtering of rain water and melting snow to remove particulate matter, the filter means repositionable or removable for cleaning without the need for removing the cover for the water pool.

10 Claims, 5 Drawing Sheets

SWIMMING POOL COVER WITH DRAINAGE AND FILTER MEANS

BACKGROUND OF THE INVENTION

1. Field of the Invention

The present invention relates to covers for swimming pools and fish ponds and similar water pools and, in particular, to a cover which permits drainage of water from the upper surface of the cover via a drain and the filtering out of particulate contaminants in the drained water with a filter media selectively and removably positionable in alignment with the drain without removal of the cover.

2. Description of the Prior Art

This application represents further developments over the disclosure and claims contained in U.S. patent application 08/575,736 which is incorporated by reference herein.

While the present invention relates to swimming pools, fish ponds and similar water pools, the description which follows will be directed towards swimming pools with the understanding that the application may be made for similar fish pools or other similar water pools.

Covers for swimming pools are frequently required to prevent the ingress of dirt or waste material, such as fallen leaves, into the pool during the off season when the pool is not in use. The cover also serves to prevent or reduce evaporation of water and to further reduce thermal losses from the water particularly, again, in the off season when the pool is not in use.

Covers of flexible waterproof sheet material are the preferred method of covering a swimming pool, the cover extending beyond the periphery of the pool where it is secured. Covers of this type have the disadvantage in that they sag in their unsupported areas, normally the midpoint of the pool and therefore they tend to collect rain water, melted snow and other accumulated dirt, leaves, and debris during the period when the cover is in position. The pool owner must physically remove the particulate dirt, waste and debris from the cover and drain the accumulated water in order to prevent the bursting of the cover under the weight.

A partial solution to the problem was taught in U.S. Pat. No. 3,184,764 to West wherein a drain plug was positioned at the midpoint of the cover, which would coincide with the lowest point of the sag of the cover during the off season when the cover was in position. Over this drain, was positioned a mesh screen for the purpose of retaining leaves, paper, and other debris of a coarse or large nature. This allowed the accumulated water, either from rain or melted snow, to pass through the mesh, and through the drain hole and into the pool thereby alleviating the excess weight on the cover and preventing the bursting or tearing of the cover.

While the mesh screen of the '764 patent prevented coarse debris from entering into the pool, nevertheless, particulate matter, such as dirt or decaying leaf particulate, could pass through the mesh and through the drain hole into the pool presenting a cleaning problem in the springtime when the pool cover was removed.

U.S. Pat. No. 4,233,695 to Rowney attempted to present an answer to this problem by having a pocket formed over a mesh drain in the cover with the pocket having at least one aperture allowing water to pass through the aperture, and through the mesh drain. Positioned in the pocket between the aperture and the mesh drain would be a filter media in the form of a pad of a fibrous nature which would collect the particulate matter which might not have been trapped by the mesh screen as taught in the '764 patent.

The drawback to the solution proposed by Rowney in the '695 patent is that the filter media proposed by Rowney is fixed and thus can become impregnated with particulate matter to the point where it, in effect, plugs the drainage of the water or melting snow from the cover thereby preventing its drainage and increasing the weight and burden on the swimming pool cover. The pool owner's only solution in this situation is to remove the cover and replace the filter pad.

One of the most recent developments in an attempt to solve these problems is U.S. Pat. No. 5,259,078 to Crandall in which pockets are formed on the underside of the pool cover, and the pockets are lined with a filter material such that water is allowed to pass through the pool cover through a mesh opening in the pool cover, enter the pocket and pass through the filter material and into the pool. The pocket accumulates particulate matter as a result of the filter media lining. While this structure may eliminate the passage of small debris and particulate matter into the pool, it too cannot be cleaned or removed until the pool cover is removed as admitted by the inventor. Therefore, the possibility of the filter media becoming plugged and preventing the passage of water through the filter media into the pool becomes a possibility despite the fact that a plurality of such pockets could be formed about the lowermost portion of the pool cover.

Applicant has developed a swimming pool cover which allows for the drainage of water and melting snow from the cover into the pool, while at the same time, preventing the passage therethrough of coarse waste, such as paper, leaves and branches. At the same time, Applicant's swimming pool cover provides for a filter media which would also trap the small particulate debris, such as dirt or decaying leaf particulate. Applicant's filter media would be positioned in a sleeve which would intersect the drain port of the swimming pool cover and be slidably positionable within the sleeve. The filter media would be sized in excess of the size of the drain port and would allow the pool owner to slidably position the filter media in alignment with the drain port. In this configuration, the pool owner is able to position virgin filter media in alignment with the drain port and to slidably move this filter media out of alignment when it becomes impregnated to the point where it prevents the flow of water or melting snow through the drain port. By slidably repositioning the filter media, the pool owner moves the impregnated, contaminated portion of the filter media out of alignment with the drain port and out of the sleeve where it can be cleaned and reinserted or substituted with a new filter or alternatively simultaneously move a virgin filter media into alignment with the drain port while moving the contaminated filter media out of alignment. This procedure could be performed several times during the course of a closed season, when the pool cover is in position thereby obviating the need for removal of the pool cover to clean the filter media while at the same time ensuring that no particulate matter enters the pool.

This present invention relates to the filter media and the frame for securing and positioning the filter media in alignment with various drain ports and within the sleeve by the pool owner.

OBJECTS OF THE INVENTION

An object of the present invention is to provide for a water pool cover which prevents the ingress of both coarse debris and particulate debris into the water pool while at the same time permitting the ingress of rain or melted snow which has accumulated on the water pool cover.

Another object of the present invention is to provide for a water pool cover which provides for the selective positioning of a filter media in alignment with a drain in the water pool cover to filter out and prevent the ingress of small particulate matter into the pool while at the same time permitting the ingress of rain and melted snow which has accumulated on the upper side of the pool cover.

An object of the present invention is to provide for a novel frame and filter media selectively slidably positionable within a water pool cover for collection of particulate matter.

A further object of the present invention is to provide for a novel water pool cover which provides a means by which the pool owner can effectively change the filter media without removing the pool cover from the water pool.

A still further object of the present invention is to provide for a novel water pool cover which prevents the ingress of coarse debris and particulate debris into the water pool while permitting the ingress of rain water or melting snow into the pool without contributing substantially to the weight of the water pool cover.

SUMMARY OF THE INVENTION

A cover for a water pool formed of flexible waterproof material having a drainage opening positioned therein, the cover having a sleeve defining a passageway secured on the cover and intersecting with the drainage opening, the passageway having a frame and filter means slidably positionable within the passageway in selective alignment with the drainage means thereby allowing the pool owner to selectively present virgin filter media in alignment with the drainage means on successive occasions without the need for removal of the pool cover.

DESCRIPTION OF THE DRAWINGS

These and other objects of the present invention will become evident, particularly when taken in view of the following drawings wherein.

DETAILED DESCRIPTION OF THE DRAWINGS

Figure 1:
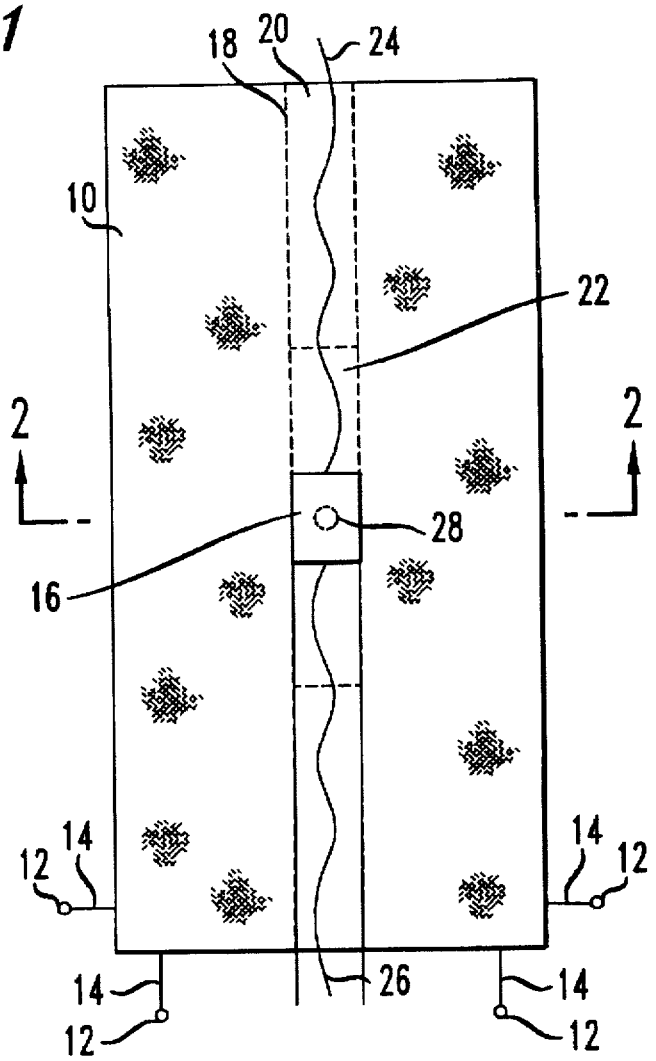
FIG. 1 is a top view of a pool cover positioned over a pool.

FIG. 1 is a top view of a pool cover 10 which has been stretched taut about the periphery of a swimming pool. Cover 10 is held in place by a plurality of anchors 12 which are positioned in the decking about the pool periphery and which secure a series of strap and spring connectors 14 which are secured to the periphery of the pool cover 10. This anchoring means is disclosed in U.S. Pat. No. 5,259,078 to Crandall as well as Applicant's Pat. No. 5,421,041.

The pool cover utilized in illustrating and explaining Applicant's novel filter mechanism is generally rectangular in shape; however, the same concept would work for pools having a different geometric shape including pools having a generally arcuate periphery. It can also have application to large municipal pools or club pools which may require multiple drainage means and multiple sleeves and passageways as described hereinabove.

In the preferred embodiment, pool cover 10, which is constructed of a sheet of flexible, waterproof material or a plurality of sheets of flexible waterproof material sewn together, would have a centrally positioned drain means 16 formed on its surface. The drain means 14 would be positioned in cover 10 at a point or on an axis where the sag of the pool cover 10 would be greatest. On very large pools or free form pools, there may be more than one sag point which would require a corresponding drain means 16. Preferably, this drain means would be of a mesh structure to permit water or melting snow to pass therethrough while at the same time retaining coarse or large debris on the upper surface of pool cover 10. This coarse or large debris could generally be blown away by natural wind currents, but could be periodically removed by the pool owner with a broom.

Secured to the underside of pool cover 10, would be a sleeve 18. Sleeve 18 may be fashioned of flexible waterproof material, or of mesh material similar to drain means 16. Sleeve 18 could either be sewn to or heat sealed with pool cover 10 or secured by mechanical means such as a zipper and would define a passageway 20 which would extend between opposing edges of pool cover 10. Sleeve 18 and formed passageway 20 would be positioned so as to intersect with drainage means 18. Slidably positioned within sleeve 18 and passageway 20 would be a filter media 22 which would be dimensioned to fit snugly within passageway 20 yet still be slidably positioned within passageway 20 by means securing line 24 secured to one end of the filter media 22 and securing line 26 secured to the opposing end of filter media 22. A drain 28 would be positioned in sleeve 18, in alignment with the mesh drainage means 16 formed in cover 10 if sleeve 18 were fashioned of flexible waterproof material.

FIG. 1 illustrates a pool with one drain means 16 and one sleeve 18 and passageway 20. As stated previously, a large or irregular shaped pool may have more than one sag point. Therefore, sleeve 18 and passageway 20 may intersect more than one drain means 16 which are in alignment with each other or there may be a plurality of sleeves 18 and passageways 20 formed to intersect unaligned drain means 16.

Figure 2:
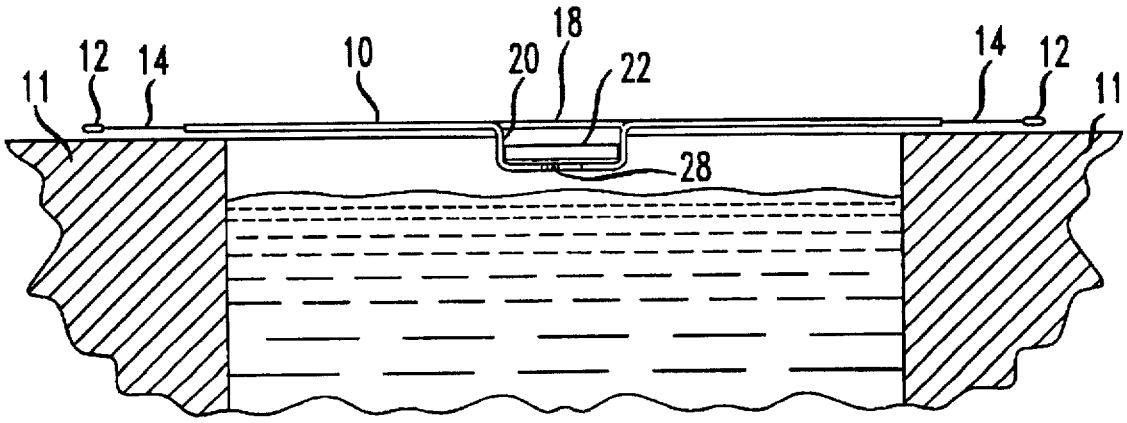
FIG. 2 is an end view of a pool cover illustrating the sleeve and filter media along axis 2—2 of FIG. 1.

FIG. 2 is a cross-sectional end view of pool cover 10 along axis 2—2 of FIG. 1. Pool cover 10 is positioned about the periphery of pool 11 by means of anchors 12 and securing means 14. Pool cover 10 is designed such that the mesh drainage means 16 is positioned over the pool area at its lowest sag point. It can be seen that sleeve 18 depends downwardly beneath cover 10 defining passageway 20 in which filter media 22 is slidably positioned. Drain 28 is formed in sleeve 18 to provide communication with the interior of pool 11. In this design, accumulated rain water or melting snow on the top of pool cover 10 is allowed to pass through the mesh drainage means 16. Mesh drainage means 16 prevents the passage therethrough of coarse or large debris, such as twigs, leaves or the like. The rain water or melting snow is then permitted to pass through filter media 22. Filter media 22 serves to collect and retain particulate matter, such as dirt, or decaying leaf particulate. The rain water or melting snow is then allowed to pass from the filter media through drain 28 and into pool 11. In this configuration, not only is large debris prevented from entering the pool interior, but also particulate matter is also prevented from entering the pool interior. Alternatively, sleeve 18 as illustrated in FIG. 2 can be fashioned of mesh material similar to that of drain means 16. This would eliminate the need for drain 28 in sleeve 18 since filtered water would pass through the mesh after having been filtered in filter media 22.

Figure 3:
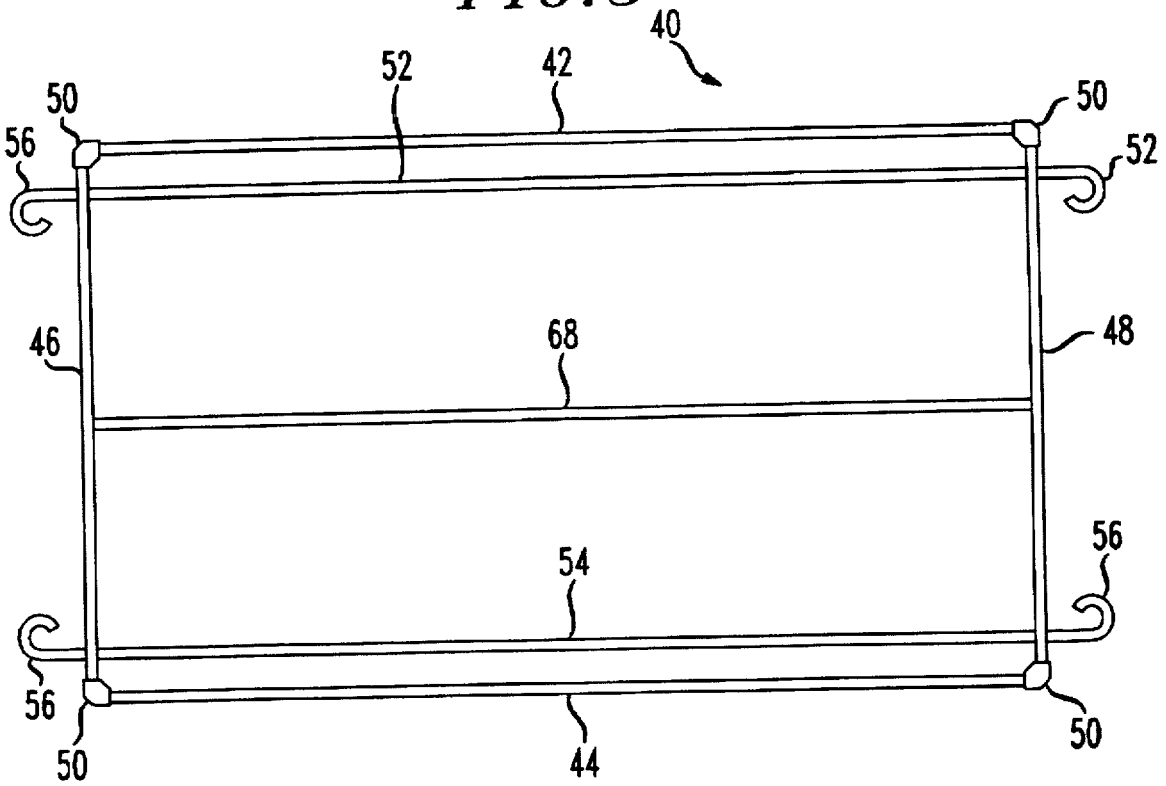
FIG. 3 is a top planar view of the frame for the filter media.

FIG. 3 is a top planar view of one embodiment of a frame for use within the sleeve of the pool cover. Frame 40 illustrated in FIG. 3 is a fixed frame constructed of, preferably, tubular members. Frame 40 comprises a generally square or rectangular frame having two lateral side members 42 and 44 and two perpendicular end members 46 and 48. The corners 50 of frame 40 are preferably rounded in that frame 40 and the length dimensions of end members 46 and 48 is designed such that it should fit snugly within the sleeve of the pool cover. Rounding the corners prevents the possibility of any tears or rips.

There is positioned inwardly from side members 42 and 44, additional tubular members 52 and 54 which are parallel to side members 42 and 44, but extend beyond end members 46 and 48 and terminate at their ends with a hook member 56. Additionally, a cross member 58 may be positioned between end members 46 and 48 to provide additional structural integrity to the frame, if required, dependent upon the material used to construct the frame. Cross member 58 terminates at end members 46 and 48.

The embodiment illustrated in FIG. 3 is the fixed frame embodiment. If the frame illustrated in FIG. 3 were constructed of aluminum or metal, all of the members would be spot welded to form a one-piece, non-detachable frame.

Figure 4:
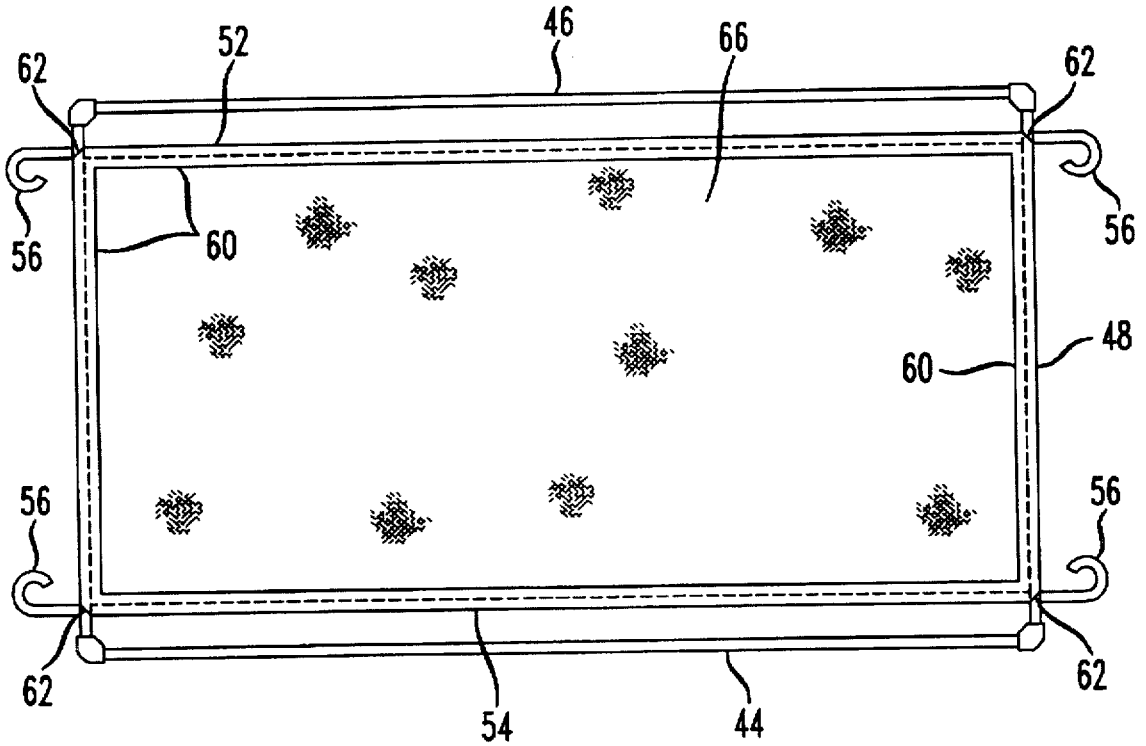
FIG. 4 is a top planar view of the frame and filter media.

FIG. 4 illustrates a top planar view of the frame 40 of FIG. 3 with the filter media 22 secured thereto. In the fixed frame design, the filter media would be cut to shape and wrapped about end members 46 and 48 and longitudinal internal members 52 and 54 and secured by a seam about the internal periphery of the area defined by end members 46 and 48 in the internal, longitudinal members 52 and 54. The seam 60 would be sewn to provide a snug fit of the filter media 22 about the respective support members with the filter media 22 forming an overlap 62 at the corners where the respective support members intersect.

As stated, the embodiment illustrated in FIGS. 3 and 4 is a fixed frame embodiment wherein the filter media would be secured to the frame in the manufacturing process. The filter media would have a mesh size of approximately 75 microns and under normal conditions, could be expected to have a life expectancy of 3 years before deterioration to weather conditions and UV light. This frame and filter media would operate as disclosed in U.S. patent application 08/575,736 with appropriate tether cords secured to hooks 56 to allow the pool owner to selectively position the frame and filter media within the sleeve of the pool cover. During its useful life, the pool owner can slide the frame and filter media outside of the sleeve and pool cover and remove particulate matter which may have collected on the filter media with a hose or by washing it with detergent or the like. The frame and filter media can then be repositioned within the sleeve and pool cover. When it becomes necessary to change the filter media, the pool owner could have the old filter media removed and a new filter media seamed onto the frame or, in the alternative, could return the entire frame and filter media assembly into the dealer for receipt of a new frame and filter media.

Figure 5:
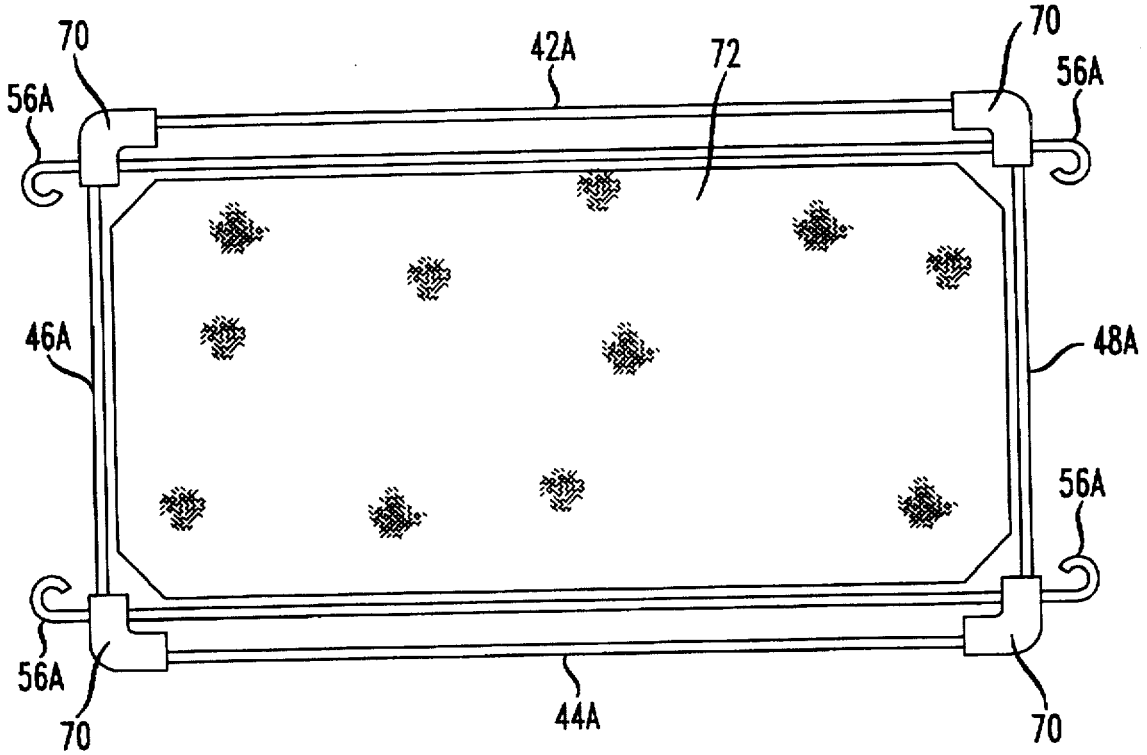
FIG. 5 is a top view of second embodiment of the frame and filter media in which the frame is a detachable frame.
Figure 6:
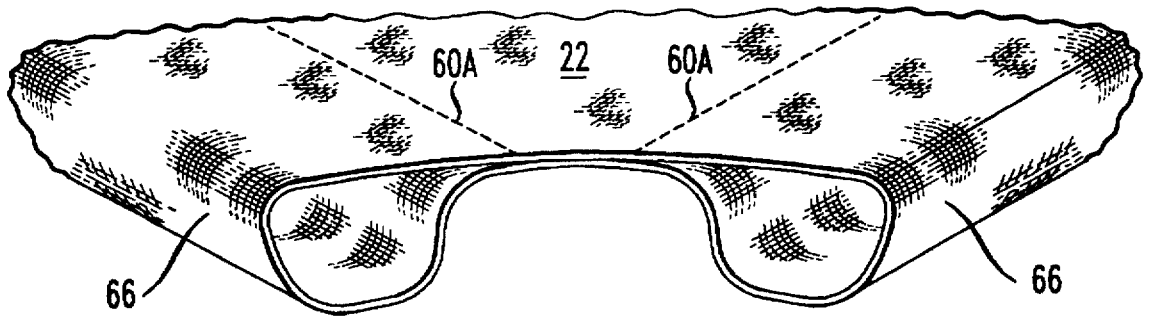
FIG. 6 is a partial perspective view of the filter media for detachable the frame.

FIG. 5 illustrates a top planar view of a second embodiment of a frame and filter media of a detachable nature which would have the primary benefit of allowing the pool owner to obtain replacement filter media and change the filter media on the frame as often as desired without the necessity of having to return the frame to the dealer. In this configuration, there would still be the longitudinal side members 42A and 44A and the perpendicular end members 46A and 48A. In the configuration illustrated in FIG. 5, these longitudinal and lateral members would be secured within or secured to corner members 70 in one of several detachable manners. This would allow the pool owner to disassemble or detach the frame in order to replace the filter media 22 with new filter media. The corner members 70 would have incorporated thereon, the hooks 56A for securing the frame to the tether cords for selective positioning of the frame and filter media. FIG. 6 is a partial perspective view of a corner of the filter media 22 showing the manner in which the filter media 22 could be preformed and pre-seamed to select dimension to be used with the detachable frame illustrated in FIG. 5. As can be seen in FIG. 6, the filter media 22 would be cut to provide for tubular sleeves 66 which would extend along the edges of the filter media. These sleeves would be dimensioned to accept the longitudinal side and lateral end members of the detachable frame as illustrated in FIG. 5 and the manner of providing for the detachable type frame is illustrated further in FIGS. 7, 8 and 9 which illustrate several embodiments which can be used for the detachable frame.

Figure 7:
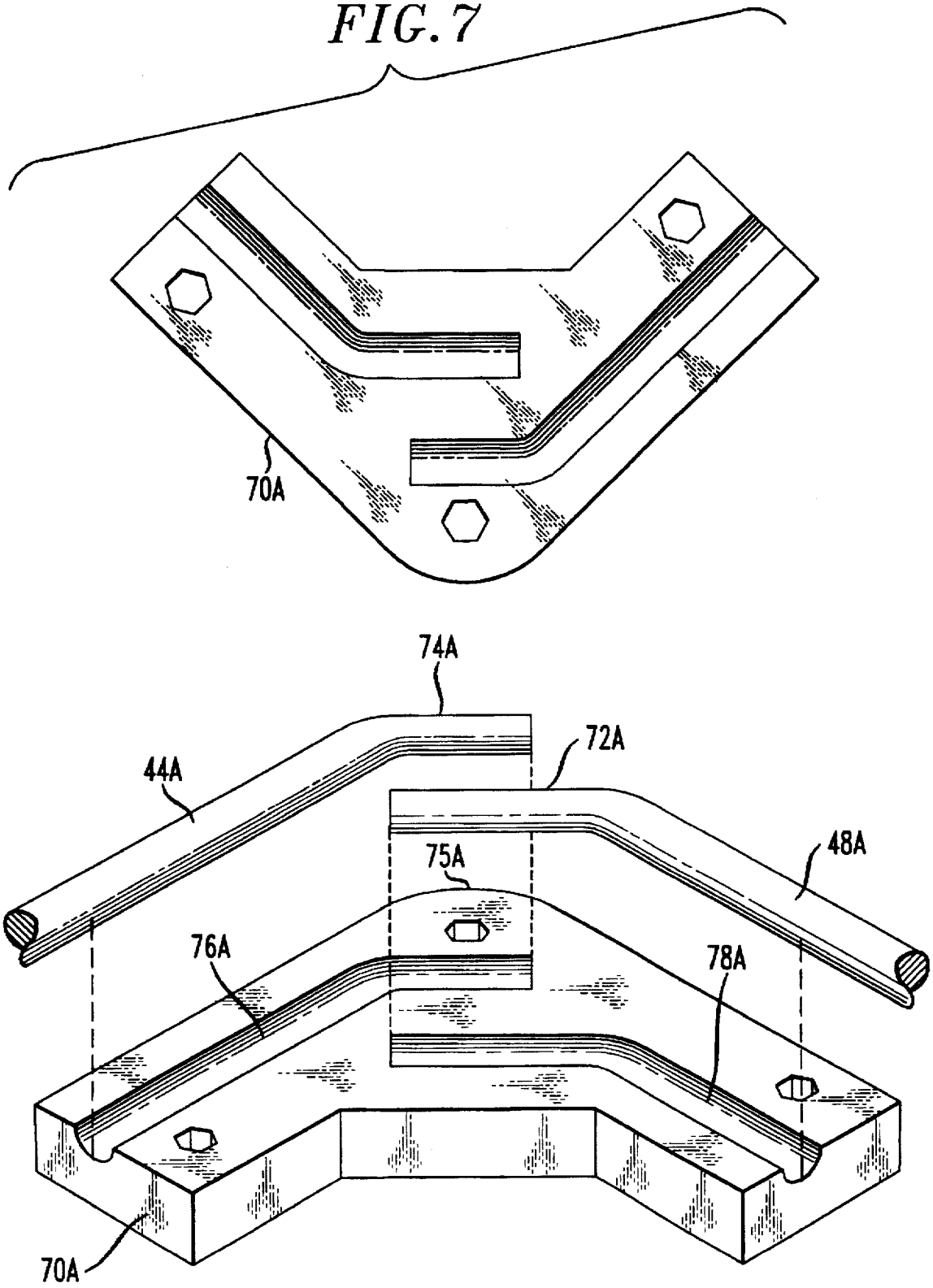
FIG. 7 is a perspective view of a corner of the second embodiment of the detachable frame.

FIG. 7 is an exploded view of corner member 70A which illustrates one embodiment of manufacturing the detachable frame 40A. In this embodiment, side members 48A would have angled end tips 72A and end members 42A and 44A would have angled end tips 74A. The corner piece 70A would be of two-piece construction, each piece having a rounded outer corner 75A to prevent damage to the sleeve and the pool cover. Each half of the corner piece would have two preformed grooves 76A and 78A. The cross-sectional shape of each groove would be that of a half circle, such that when the two end pieces were fit together, the groove would form a tubular bore having angled interior ends. Thus, the angled end member 72A of one side member 48A would be positioned in groove 78A and a side member 44A would have its tip ends 74A positioned in groove 76A. The other end member 70A would then be placed above the first member, thus sandwiching the two end tips between the two identical corner members. A plurality of apertures would be formed in the corner members, coincidental with each other, such that a fastener could be utilized to secure the corner members with the end member and side members secured therein and maintained in a secure position as a result of the angled tips of the end members and side members. This procedure would be followed at all four corners of the frame. With this configuration, it can be seen with the preformed filter media 22 as disclosed in FIG. 6, a detachable frame 40A can be disassembled and the respective end members and side members positioned through sleeves 66 on the filter media and then reassembled with the appropriate corner members.

Figure 8:
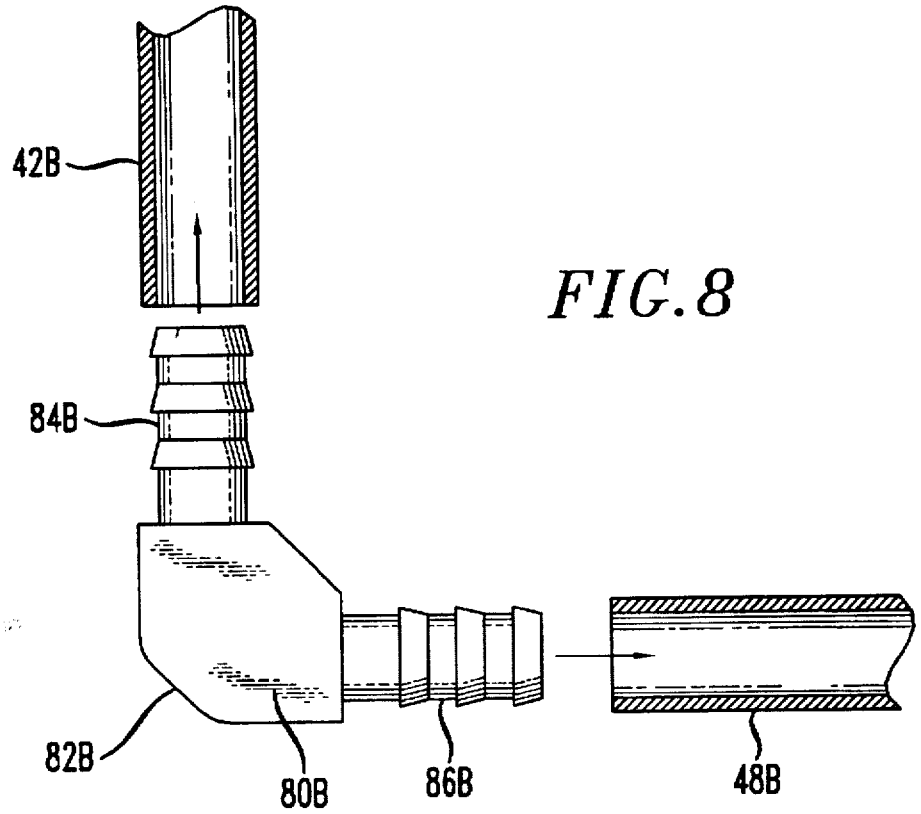
FIG. 8 is a top exploded view of a corner of a third embodiment of a detachable frame.

FIG. 8 illustrates still another embodiment for assembling a detachable frame 40A so that the pool owner can change the filter media 22 as desired. FIG. 8 is a top planar view of another embodiment of a corner member which could be utilized for the assembly and disassembly of frame 40A. In this embodiment, the corner member 70B comprises a body member 80B having a rounded outer edge 82B for the same reasons previously set forth. Extending from body member 80B at 90° angles would be a frictionally engageable tubular member 84B and 86B. In this configuration, the side members 42B and end members 48B would be tubular in shape having a throughbore frictionally cooperative with members 84B and 86B, such as to be frictionally secured to 84B and 86B at each corner of the frame 70B, yet still be disengaged by force to allow filter media 22 to be secured thereto in accordance with the prefitted design of the filter media as illustrated in FIG. 6.

Figure 9:
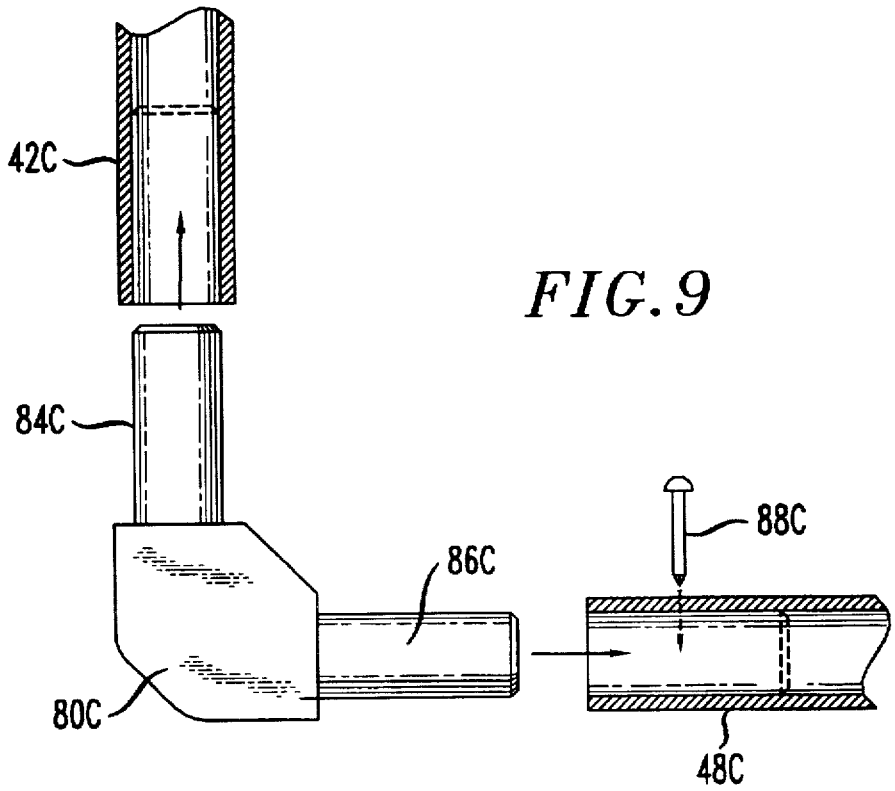
FIG. 9 is a top exploded view of a corner of a fourth embodiment of a detachable frame.

FIG. 9 illustrates still another embodiment of a corner member for a detachable frame similar to that disclosed in FIG. 8 with the exception that in the embodiment illustrated in FIG. 9, the engaging members 84C and 86C, which extend outwardly from body member 80C, would not rely primarily on frictional engagement with the throughbore of tubular side members 48C and end members 42C, but would also have coincidental apertures, such that a pin member 88C could be secured through said aligned apertures to secure the corner member to the tubular side members and end members.

In each of the embodiments illustrated in FIGS. 7, 8 and 9, the hooks 56A would be incorporated on the body members of each corner member. Further, in all instances with respect to the embodiments disclosed herein, the hook members would be used to secure the tether lines, as disclosed in the aforesaid U.S. patent application incorporated herein so that the pool owner can slidably adjust and/or remove the frame and filter media from the sleeve of the pool cover for replacement and/or cleaning and then re-position the frame and filter media in the appropriate position.

While the present invention has been described in connection with the exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. A filter means for a cover for a water pool wherein said cover for said water pool comprises a sheet of flexible, waterproof material having a drainage opening position therein, said sheet of flexible, waterproof material adapted to be secured about the periphery of said water pool, said cover having a sleeve defining a passageway secured on said sheet of flexible, waterproof cover, said sleeve defining a passageway in alignment with and intersecting said drainage opening, said filter means selectively positioned in said sleeve defining said passageway, said filter means having a planar area dimension greater than the planar area dimension of said drainage opening, said filter means permitting the passage of water therethrough, said filter means preventing the passage of particulate matter therethrough by accumulation of said particulate matter in said filter means, said filter means further comprising;

a fixed frame having parallel lateral end members and outer parallel longitudinal side members, there being disposed internally from said longitudinal side members, a pair of internal longitudinal members parallel to said outer longitudinal side members and secured to said lateral end members;

a mesh filter cloth secured about the said lateral end members and said internal longitudinal members;

a securing means secured to the external side of said lateral end members for securing a positioning means to said frame.

2. The filter means in accordance with claim 1 wherein said fixed frame has secured between said lateral end members, a central bracing member secured at the mid point of said parallel lateral end members.

3. The filter means in accordance with claim 1 wherein said filter mesh cloth is secured about said lateral end members and said internal longitudinal members by means of stitching.

4. The filter means in accordance with claim 1 wherein said filter mesh cloth is secured about said members by adhesive.

5. The filter means in accordance with claim 1 wherein said securing means secured to said external side of said lateral end members comprises a plurality hook means for receipt of a tether line secured to said frame and to position said frame within said sleeve in alignment with said drain.

6. The filter means in accordance with claim 1 wherein said lateral end members and said longitudinal side members are circular in cross section and the intersecting corners of said lateral end members and said longitudinal side members are rounded to prevent tearing of said sleeve or said cover.

7. A filter means for a cover for a water pool wherein said cover for said water pool comprises a sheet of flexible, waterproof material having a drainage opening position therein, said sheet of flexible, waterproof material adapted to be secured about the periphery of said water pool, said cover having a sleeve defining a passageway secured on said sheet of flexible, waterproof cover, said sleeve defining a passageway in alignment with an intersecting said drainage opening, said filter means selectively positioned in said sleeve defining said passageway, said filter means having a planar area dimension greater than the planar area dimension of said drainage opening, said filter means permitting the passage of water therethrough, said filter means preventing the passage of particulate matter therethrough by accumulation of said particulate matter in said filter means, said filter means further comprising;

a detachable tubular frame having a pair of tubular parallel lateral end members and a pair of tubular parallel longitudinal side members, and four corner members, each corner member having a pair of cylindrical arms positioned thereon in 90 degree relationship to each other, said arms are on said corner pieces being dimensioned to engage the internal walls of said tubular lateral end members and tubular longitudinal side members adjacent thereto to form a generally rectangular frame;

a mesh filter cloth generally rectangular in shape and dimensioned to the size of said frame, said mesh filter cloth having a sleeve formed along each longitudinal edge and each lateral edge, each said sleeve having an opening at opposing ends, said mesh filter cloth slidably mountable on said lateral end members and longitudinal side members by slidably inserting the said lateral end members and said longitudinal side members into the respective sleeves formed on said mesh filter cloth securing said lateral end members and longitudinal side members to said corner members by frictional engagement.

8. The filter means in accordance with claim 7 wherein said cylindrical arms positioned on said corner members are dimensioned to frictionally engage the internal walls of said tubular lateral end members and tubular longitudinal side members adjacent thereto.

9. The filter means in accordance with claim 7 wherein said pair of cylindrical arms positioned on said corner members are dimensioned to engage the inner walls of said tubular lateral end members and tubular longitudinal side members adjacent thereto, there being complimentary apertures in said tubular lateral end members and said tubular longitudinal side members and said arms of said corner members for receipt of a retaining pin.

10. A filter means for a cover for a water pool wherein said cover for said water pool comprises a sheet of flexible, waterproof material having a drainage opening position therein, said sheet of flexible, waterproof material adapted to be secured about the periphery of said water pool, said cover having a sleeve defining a passageway secured on said sheet of flexible, waterproof cover, said sleeve defining a passageway in alignment with an intersecting said drainage opening, said filter means selectively positioned in said sleeve defining said passageway, said filter means having a planar area dimension greater than the planar area dimension of said drainage opening, said filter means permitting the passage of water therethrough, said filter means preventing the passage of particulate matter therethrough by accumulation of said particulate matter in said filter means, said filter means further comprising;

a detachable frame having a pair of parallel lateral end members having angled end portions, a pair of parallel longitudinal side members having angled end portions, four corner members, each corner member comprised of two complimentary elements having complimentary grooves formed therein for the receipt and securing of said angled ends of said adjacent lateral end member and said adjacent longitudinal member thereby forming a generally rectangular frame;

a mesh filter cloth generally rectangular in shape and dimensioned to the size of said frame, said mesh filter cloth having a sleeve formed along each longitudinal edge and each lateral edge, each said sleeve having an opening in opposing ends, said mesh filter cloth slidably mountable on said lateral end members and said longitudinal side members by slidably inserting said lateral end member and said longitudinal side member into the respective sleeves formed on said mesh filter cloth, positioning the angled ends of said lateral end member and said longitudinal side member between the respective corner elements of said four corner members and securing said corner elements of said four corner members with a fastening means.

* * * * *